US005821499A

United States Patent [19]

Crimmins et al.

[11] Patent Number: 5,821,499

[45] Date of Patent: Oct. 13, 1998

[54] HEATED ROLLER ASSEMBLY

[75] Inventors: Robert Allen Crimmins, Algonquin, Ill.; Lawrence B. LeStarge, Elgin, Ill.; Bruce E. Hyllberg, Gurnee, Ill.; Gary S. Butters, Greenfield, Wis.

[73] Assignees: D & K Custom Machine Design, Inc., Elk Grove Village, Ill.; American Roller Company, Union Grove, Wis.

[21] Appl. No.: 414,430

[22] Filed: Mar. 31, 1995

[51] Int. Cl.[6] ..... H05B 3/42

[52] U.S. Cl. ..... 219/471; 219/469

[58] Field of Search ..... 219/216, 244, 219/469, 471, 541, 543; 432/60, 228; 439/19; 165/89

[56] References Cited

U.S. PATENT DOCUMENTS

| | | | |
|---|---|---|---|
| 2,248,394 | 7/1941 | Sorensen . | |
| 2,634,357 | 4/1953 | Steward . | |
| 3,243,579 | 3/1966 | Sussin . | |
| 3,439,307 | 4/1969 | Ruscher . | |
| 3,582,616 | 6/1971 | Wrob . | |
| 3,720,808 | 3/1973 | Morrissey . | |
| 4,109,135 | 8/1978 | Minden et al. . | |
| 4,213,031 | 7/1980 | Färber . | |
| 4,269,594 | 5/1981 | Umans et al. | 432/59 |
| 4,319,949 | 3/1982 | Thissen et al. | 156/446 |
| 4,321,759 | 3/1982 | Gamble | 165/89 |
| 4,395,109 | 7/1983 | Nakajima et al. . | |
| 4,468,069 | 8/1984 | Meal et al. | 339/6 A |
| 4,493,982 | 1/1985 | Romansky | 219/469 |
| 4,618,240 | 10/1986 | Sakurai et al. . | |
| 4,628,183 | 12/1986 | Satomura | 219/216 |
| 4,776,070 | 10/1988 | Shibata et al. | 29/130 |
| 4,820,904 | 4/1989 | Urban | 219/216 |
| 5,191,381 | 3/1993 | Yuan | 355/285 |
| 5,235,163 | 8/1993 | Levitan | 219/541 |
| 5,303,016 | 4/1994 | Oda et al. | 219/216 |

FOREIGN PATENT DOCUMENTS

| | | |
|---|---|---|
| 287599 | 7/1931 | Italy . |
| 59-154477 | 9/1984 | Japan . |
| WO 94/16539 | 7/1994 | WIPO . |

OTHER PUBLICATIONS

PCT International Search Report PCT/US96/04371.

*Primary Examiner*—Teresa J. Walberg
*Assistant Examiner*—Gregory L. Mills
*Attorney, Agent, or Firm*—Wallenstein & Wagner, Ltd.

[57] ABSTRACT

A heated roller assembly (10) is disclosed having a rotatable roller (12). The roller (12) has a generally cylindrical section (20) with an outer diameter D and includes an inner insulative layer (36) thereover, a conductive layer (38) over the inner insulative layer (36), and an outer insulative layer (40) over the conductive layer (38). The roller assembly (10) also has an inwardly projecting conical portion (22) adjacent the cylindrical section (20) of the roller (12) with the inner insulative layer (36), conductive layer (38) and outer insulative layer (40) respectively thereover. A portion (A) of the conductive layer (38) on the conical portion (22) of the roller (12) is exposed. An external contact body (14) has at least one electrically conductive outer surface (46) that projects towards and contacts the conductive layer (38) of the conical portion (22) while piercing an imaginary plane P1 formed by an extending outer diameter (D) of the cylindrical section (20). A wire (18) having one end connected to the outer surface (46) of the contact body (14) delivers electricity to heat the roller (12).

34 Claims, 5 Drawing Sheets

HEATED ROLLER ASSEMBLY

TECHNICAL FIELD

The present invention relates generally to a heated roller assembly, and more particularly, to an electrically heated roller wherein the heating element is an integral part of the roller.

BACKGROUND OF THE INVENTION

There are numerous applications for heated rollers. Heated rollers are used in laminating machines, printing presses, photocopy machines and computer printers. An important aspect in these applications is the physical construction of the heating element of the rollers.

In some applications, the roller is heated using a closed-loop heat exchanger system. For example, heated oil or water is pumped through tubes, axially disposed through the length of the roller. Heat is transferred from the tubes to the outer surface of the roller via an internal path. Problems exist, however, with these type of systems. Oil systems can leak and thus contaminate the roller assembly and product passing over the roller. In addition, such system's efficiency is low.

Another method used in some applications to heat a roller is by conducting electricity through an outer surface of the roller. A conductive layer is normally applied to the outer surface of the roller to improve the conduction and heat generating capabilities of the roller. An external conductive element, electrically connected to an external power supply, contacts the conductive layer of the roller. The connection is normally made near the ends of the roller. Electricity is then supplied to the conductive layer via the conductive element. A resistance in the conductive layer generates heat, thus providing a heated roller.

The conductive element, however, contacts the roller in a direction transverse to the longitudinal axis of the roller. Accordingly, the conduction element extends beyond a plane defined by an outer diameter of the roller. Thus, at the ends of the roller, more space is required around the circumference of the roller to accommodate the transversely positioned conductive element.

Problems exists, however, with such a configuration where the conductive element extends beyond the plane defined by the outer diameter of the roller. First, space is a factor in many applications of heated rollers. The conductive element must fit within tight clearances. The transverse conductive element requires more space around the circumference of the roller. Furthermore, because the roller is usually journaled at its ends for rotation, the available space is taken up by bearing assemblies.

Another problem exists when such configurations are used in lamination machines. If a sheet, having a greater width than the roller of the lamination machine, is passed through the machine, the excess width of the sheet collides with the transversely positioned conductive element. The sheet could then become lodged in the machine and damage the roller, conductive element, or both.

In addition, many conductive elements that contact the outer surface of the roller are stationary and do not rotate together with the roller. These conductive elements include brushes that engage the outer surface of the roller as the roller rotates therein. The brush-type connections do not provide as good a conductive connection as solid connections that rotate with the roller. The heat generating capabilities, therefore, are inferior to applications using solid connections. In addition, the brushes wear and must be replaced periodically.

Conductive elements that do not rotate with the roller also pose another problem. Depending on the thermal properties of the roller, when heated, the roller may expand in a direction parallel to its longitudinal axis. This is generally referred to as the roller "walking." The stationary conductive element is normally externally supported and does not move with the roller. As the roller walks, the roller collides with the conductive element, or the element's support structure, thus damaging the roller, conductive element, or both.

SUMMARY OF THE INVENTION

The present invention solves many of these and other problems, and relates to a heated roller assembly. According to a first aspect of the invention, the heated roller assembly includes a roller having two sections. The roller has a first section with a first diameter and a second section with a second diameter. The first diameter is greater than the second diameter. A conductive element is connected to the second section of the roller and is also connected to a heater element integral with the first section of the roller. An external contact body has at least one electrically conductive outer surface projecting toward and contacting the conductive element of the second section of the roller. While contacting the conductive element, the outer surface of the contact body passes through an imaginary plane formed by extending the first diameter of the first section. There is also means for electrically connecting the outer surface of the contact body to a power supply.

According to another aspect of the present invention, the first section of the roller is centrally positioned and the second section forms an end of the roller. The contact body is annular and has an outer diameter less than the first diameter of the first section of the roller. An insulated end cap, having an outer diameter less than the first diameter of the first section, holds the contact body and is affixed to the end of the roller by a fastener.

According to a further aspect of the present invention, the first section of the roller is generally cylindrical and includes an inner insulative layer thereover, a conductive layer over the inner insulative layer, and an outer insulative layer over the conductive heat layer. The second section of the roller is an inwardly projecting conical portion adjacent the cylindrical first section with the inner insulative layer, conductive layer and outer insulative layer respectively thereover. A portion of the conductive layer on the conical portion of the roller is exposed.

According to still another aspect of the invention, the roller, contact body and cap rotate together.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
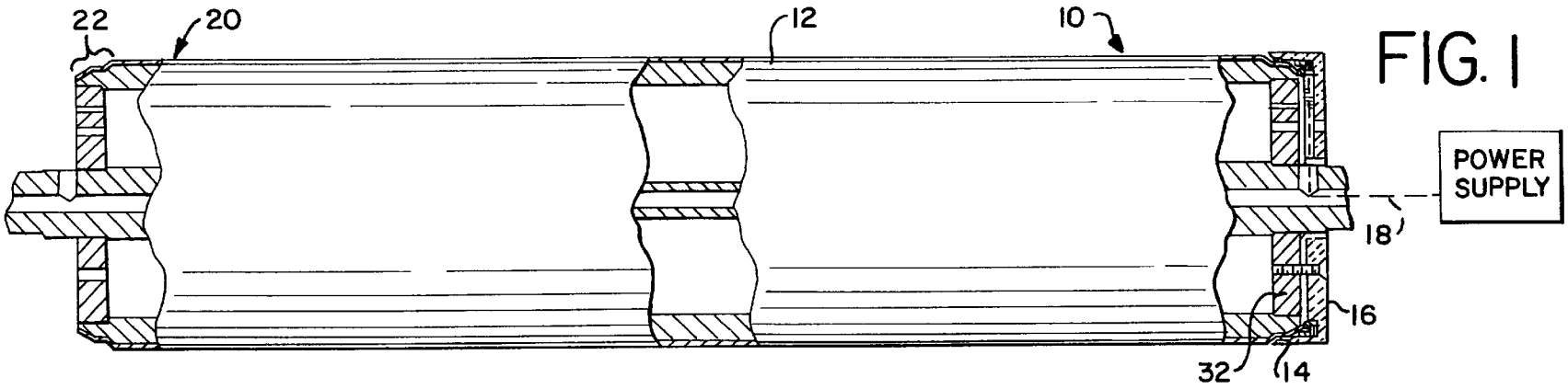
FIG. 1 is a front elevation view of a heated roller assembly made in accordance with the present invention having partial cross-sectional front views at the center and ends of the roller assembly.

While this invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows the heated roller assembly of the present invention, generally designated by the reference number 10. The heated roller assembly 10 generally includes a rotatable roller 12, a contact body 14, a cap 16, and a wire 18 for delivering electricity to the roller assembly 10. The structure of these elements will be described first, and then the construction and operation of the roller assembly will be described.

Structure of the Heated Roller Assembly

Figure 3:
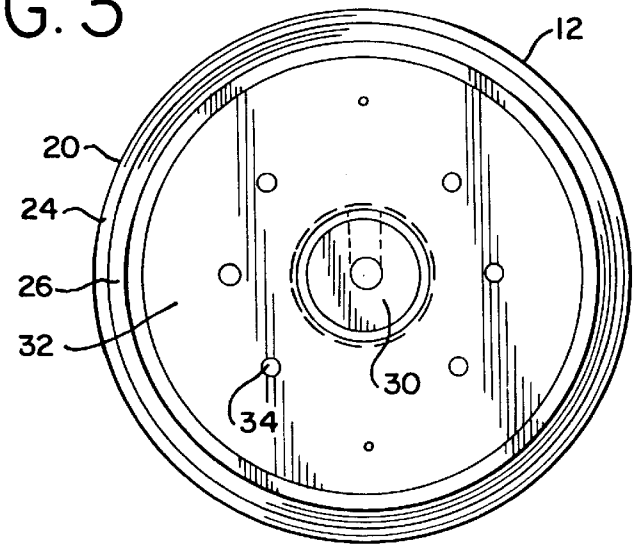
FIG. 3 is an end elevation view along line 3—3 in FIG. 2.
Figure 2:
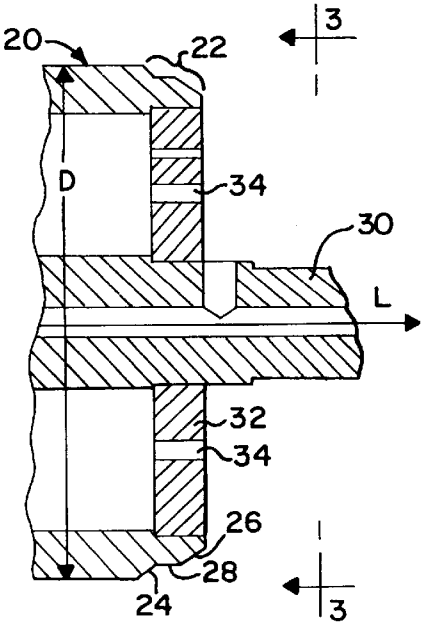
FIG. 2 is a cross-sectional view of an end of a roller.

Turning to FIGS. 1–3, the roller 12 is preferably made of steel but other materials could also be used. The roller 12 has a generally cylindrical section 20 with an outer diameter "D," and an inwardly projecting conical portion 22 at each end of the roller. In its preferred form, this conical portion 22 is located at each end of the roller 12. It will be understood by those skilled in the art, however, that the roller 12 could have the conical portion 22 at only one end or even a conical portion 22 between the ends of the roller 12. In addition, this conical portion 22 can be replaced by another cylindrical section having a diameter less than the diameter D of the cylindrical section 20. In its preferred form and as best disclosed in FIG. 2, the conical portion 22 includes two beveled sections 24,26 separated by an intermediate section 28.

End plates 32 are welded to the roller 12 at the ends of the roller 12. A shaft 30 passes axially through the roller 12 and is welded to end plates 32 to anchor the shaft 30 within the roller 12. Each end plate 32 has openings 34 to receive fasteners 62. The shaft 30 is journaled at its ends (not shown) to allow the roller to rotate. FIG. 3 discloses an end view of the roller 12 showing the shaft 30, end plate 32 and cylindrical section 20.

Figure 6:
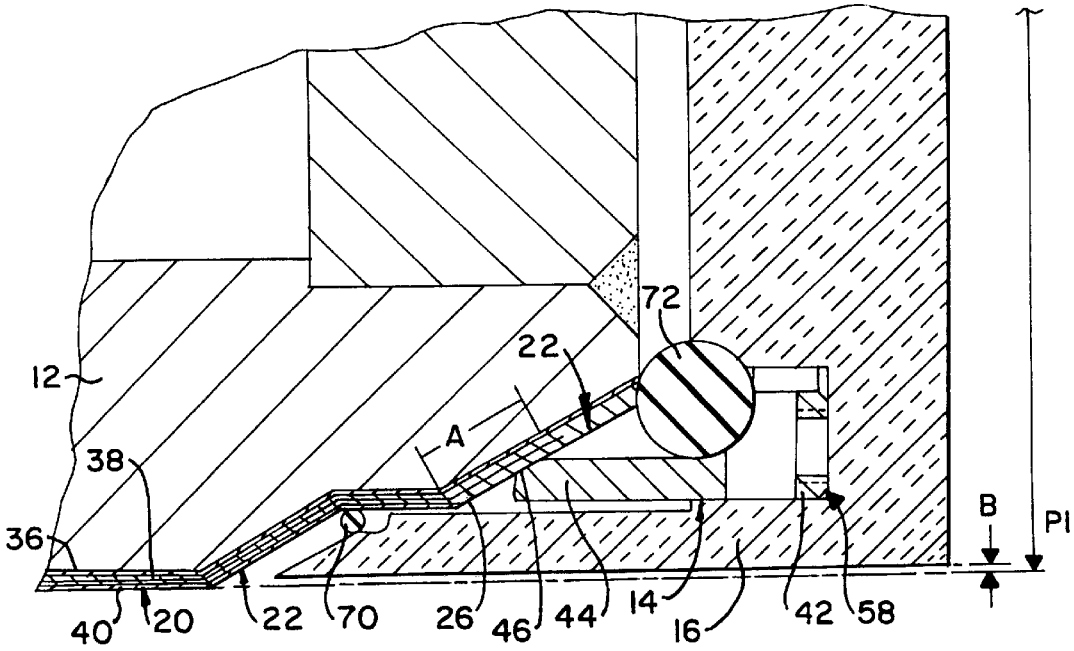
FIG. 6 is a further enlarged cross-sectional view of the roller assembly of FIG. 4 showing the contact body contacting a conical portion of the roller.

As shown in FIG. 6, three layers of material are included in the cylindrical section 20 and conical portion 22. Insulative material is applied, e.g., sprayed onto the cylindrical section 20 in a high-speed, high-temperature process, to form an inner insulative layer 36 thereover. A conductive layer 38 (a conductive or heater element) is then applied (sprayed, if desired) over the inner insulative layer 36. Finally, an outer insulative layer 40 is put over the conductive layer 38. This outer insulative layer 40 is ceramic and protects the conductive layer 38. In its preferred form, the layers 36,38,40 are also applied to and integral with the conical portion 22 of the roller 12. It is appreciated that other electrical configurations can be established as long as the cylindrical section 20 is electrically connected to the conical portion 22. As further disclosed in FIG. 6, the layers 36,38,40 are staggered. In such configuration, a portion "A" of the conductive layer 38 is exposed on the beveled section 26 of the conical portion 22.

The layers 36,38,40 are ceramic and can be ordered from, and applied to the roller 12, by the American Roller Co. located at 2223 Lakeside Dr., Bannockburn, Ill. 60015, under the trademark Thermalon®. The thickness of the inner insulative layer 36 is normally 30 thousandths of an inch. The thickness of the conductive layer 38 is 10 thousandths of an inch, although this thickness can vary depending on the heat requirements of the roller 12. The outer insulative layer 40 is normally 30 thousandths of an inch.

Figure 7:
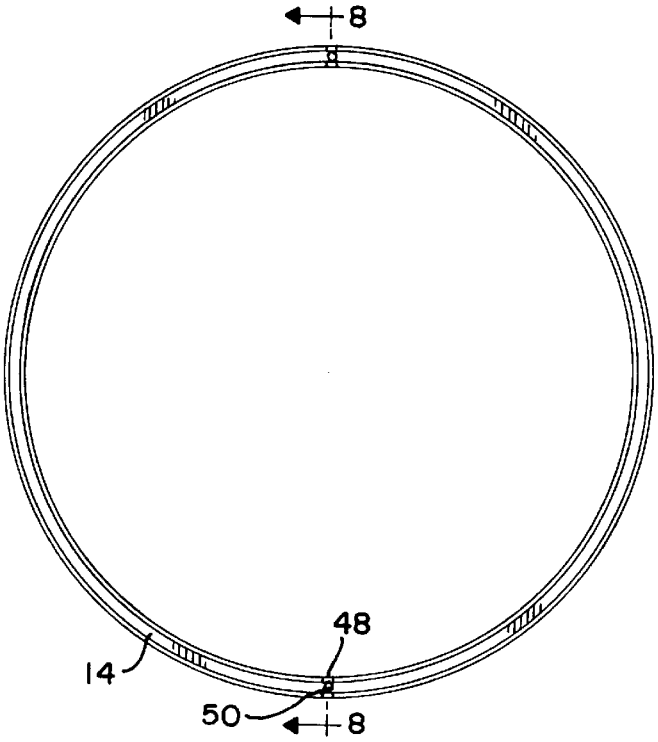
FIG. 7 is an end elevation view of the contact body of FIG. 4.
Figure 8:
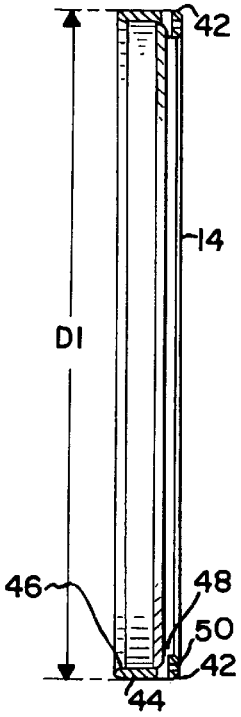
FIG. 8 is a cross-sectional view of the contact body of FIG. 4 taken along line 8—8 in FIG. 7.
Figure 11:
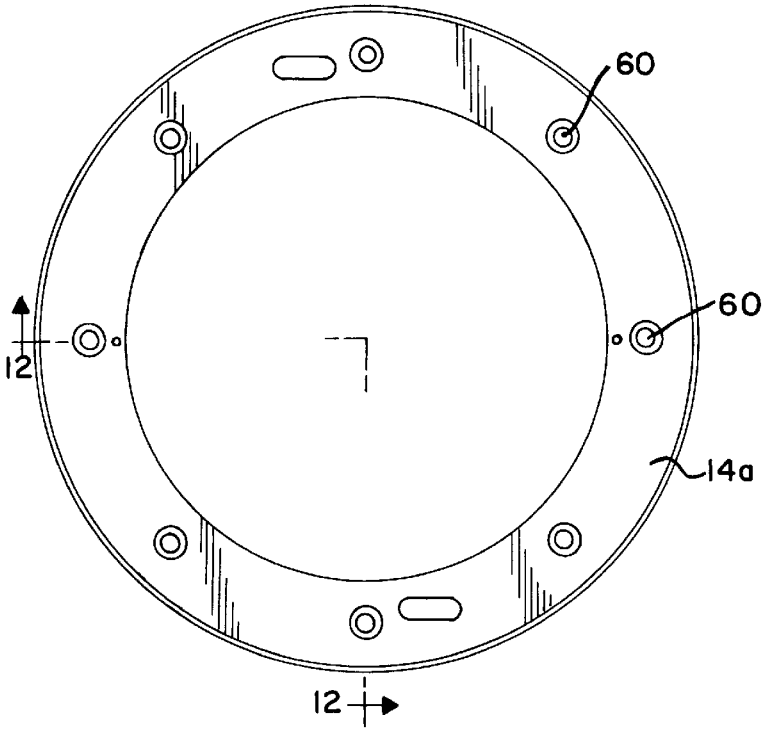
FIG. 11 is an end elevation view of another embodiment of the contact body.
Figure 12:
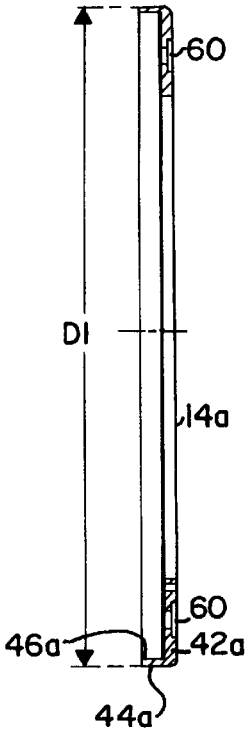
FIG. 12 is a cross-sectional view of the contact body of FIG. 11 taken along line 12—12 in FIG. 11.
Figure 13:
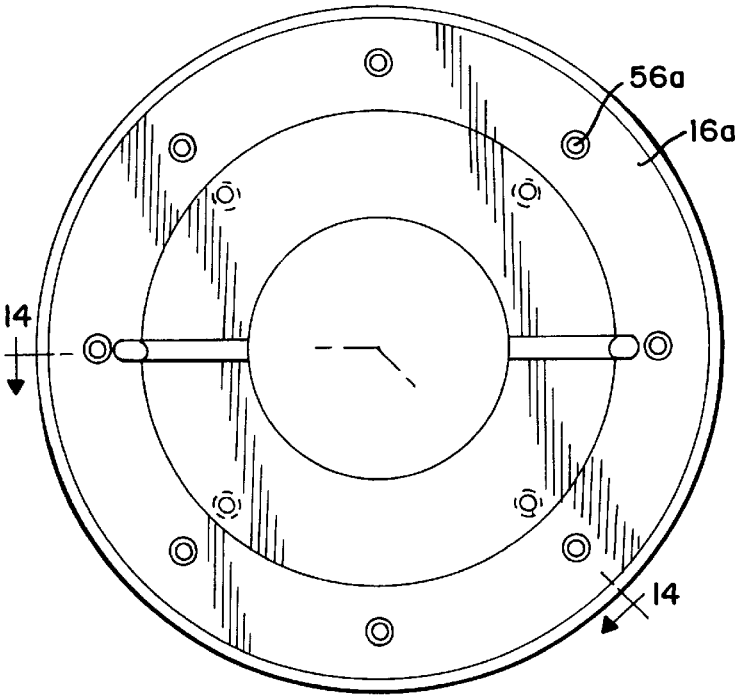
FIG. 13 is an end elevation view of another embodiment of the end cap.
Figure 14:
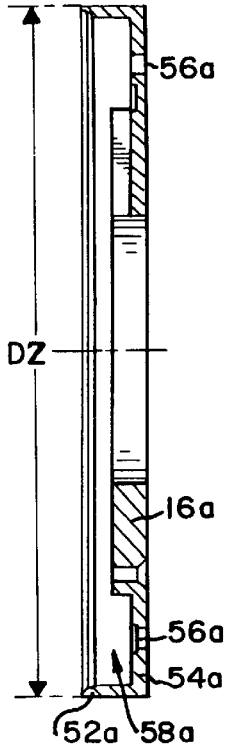
FIG. 14 is a cross-sectional view of the end cap of FIG. 13 taken along line 14—14 in FIG. 13; and, FIG. 15 is an enlarged cross-sectional view of the heated roller assembly having the contact body of FIGS. 11–12 and the end cap of FIGS. 13–14 with a spring biasing the contact body against the conical portion of the roller.

FIGS. 7 and 8 disclose a first embodiment of the contact body 14 of the present invention. The contact body 14 has a base 42 and an extending flange 44. The flange 44 includes an electrically conductive outer surface 46. In the alternative, the entire contact body is made of conductive material such as steel or nickel. The base 42 also has openings 48,50 therein for receiving wires to electrically connect the outer surface 46. The contact body 14 is annular and has an outer diameter D1, which is less than the outer diameter D of the cylindrical section 20.

Figure 9:
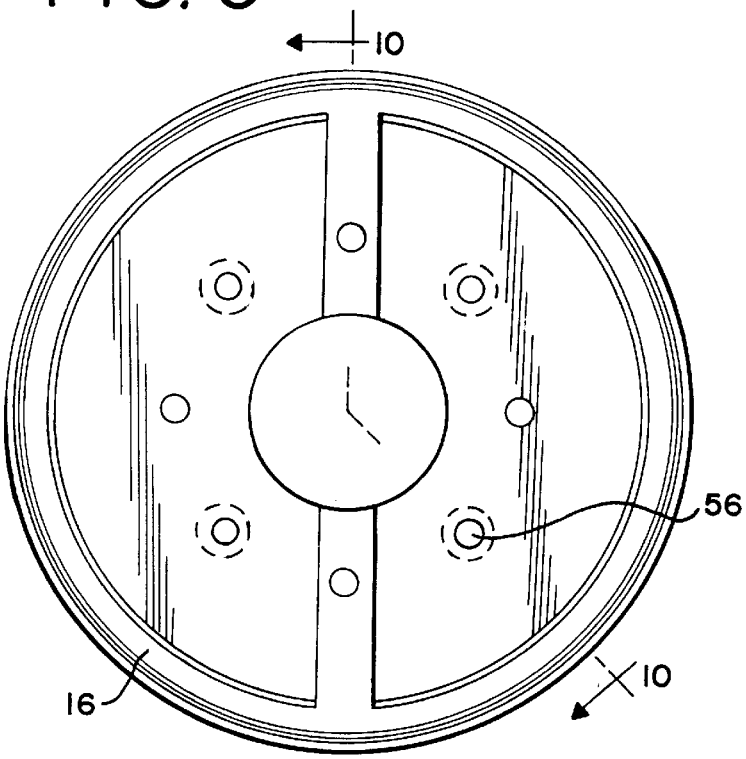
FIG. 9 is an end elevation view of the end cap of FIG. 4.
Figure 10:
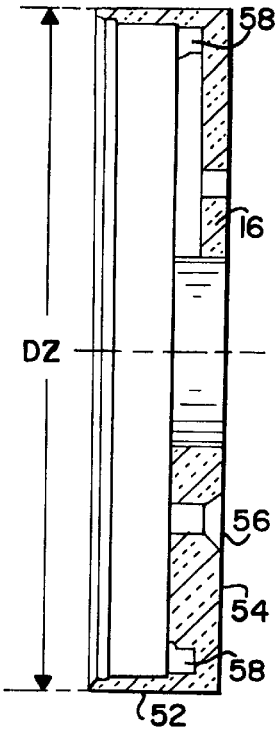
FIG. 10 is a cross-sectional view of the end cap shown in FIG. 4 taken along line 10—10 in FIG. 9.

FIGS. 9 and 10 disclose a first embodiment of the insulated end cap 16 affixed to the end of the roller 12 having the conical portion 22. This end cap is used in conjunction with the contact body 14 disclosed in FIGS. 7 and 8. The end cap 16 is made of a phenolic material or steel to insulate the contact body 14 and minimize heat loss. Specifically, the end cap 16 includes a sleeve 52 having a closed end 54. The end cap 16 has an internal circular channel 58 for holding the base 44 of the contact body 14 therein. Finally, the closed end 54 has a plurality of openings 56 to receive fasteners 62, such as bolts, for affixing the end cap 16 to the end of the roller 12 having the conical portion 22. Like the contact body 14, the cap 16 is also annular and has an outer diameter D2, which is less than the outer diameter D of the cylindrical section 20.

FIGS. 11–12 and 13–14 show a second embodiment of a contact body **14*a* and an insulated end cap 16*a*, respectively, used in the heated roller assembly 10. The general structure of these elements are identical to those disclosed in FIGS. 7–10. Identical elements are indicated with the same reference numerals except with the addition of an "a" designation. In this latter embodiment, the contact body 14 is held differently by the end cap 16*a*. The contact body 14*a* has apertures 60 that correspond with the openings 56***a* in the closed end 54*a* of the end cap 16*a*. The opening 56*a* and aperture 60 receive fasteners 62*a* for affixing the end cap 16*a* to the roller 12.

As shown in FIG. 1, the conductive wire 18 (represented by a dashed line) electrically connects the outer surface 46 of the contact body 14 to a power supply (shown schematically).

Construction and Operation of the Heated Roller Assembly

FIGS. 1, 4, 5 and 6 shows the heated roller assembly 10 completely constructed. The contact body 14 is positioned toward the end of the roller 12 to contact the conical portion 22. The end cap 16 is positioned over the contact body 14 and holds the contact body 14 against the roller 12. The end cap 16 is affixed by fasteners 62 to the end of the roller 12 having the conical portion 22. The wire 18 electrically connects the conductive outer surface 46 of the contact body 14 to a power supply. The conductive outer surface is electrically connected to the conductive layer 38 on the conical portion 22 and cylindrical section 20. Resistance in the conductive layer 38 generates heat which heats the roller 12.

Figure 4:
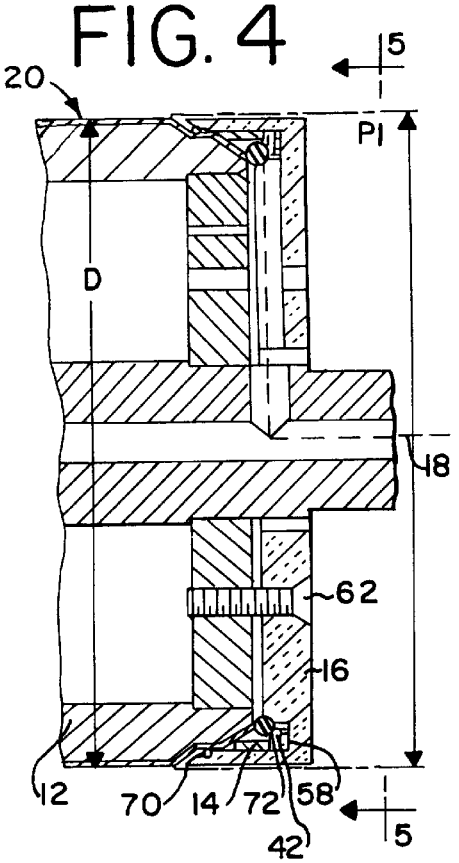
FIG. 4 is an enlarged cross-sectional view of the end of the roller of FIG. 1 showing the roller, a contact body and an end cap.
Figure 5:
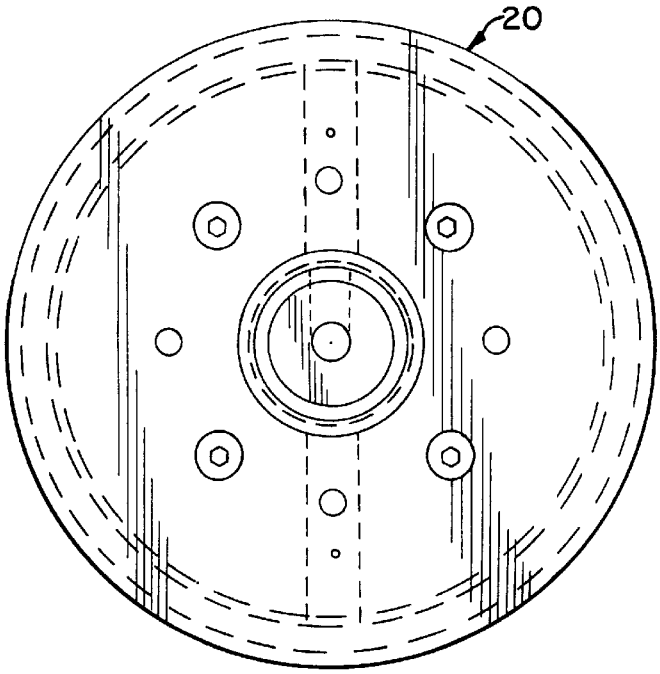
FIG. 5 is an end elevation view along line 5—5 in FIG. 4.

FIGS. 4 and 6 disclose, in greater detail, the contact body 14 contacting the roller 12. As seen in FIG. 6, the electrically conductive outer surface 46 of the contact body 14 projects towards and contacts the conductive layer 38 of the conical portion 22. The conductive outer surface 46 contacts the conductive layer 38 at the portion A on the conical portion 22 of the roller 20. With such configuration, an electrical connection with the outer surface of the roller is made without requiring a contactor positioned transversely to the longitudinal axis of the roller 12. Thus, the roller assembly 10 can fit better within tight or narrow clearances not possible with prior devices. Because the contact body is preferably annular, the outer surface contacts the conical portion 22 around the entire circumference of the roller. This maximizes the contact area and, thus, improves the conductivity to the conductive layer 38.

As the outer surface 46 contacts the conical portion 22, it is maintained within an imaginary cylindrical plane P1 formed by extending the outer circumference of the cylindrical section 20 (FIGS. 4 and 6). This plane P1 is defined by extending the diameter corresponding to the outer diameter D of the cylindrical section 20. Thus, the contact body 14 stays within the plane P1 defined by the outer diameter D. In its preferred form, the outer diameter D1 of the contact body 14 is less than the outer diameter D of the cylindrical section 20 and thus, the contact body 14 is positioned with in the plane P1.

As further disclosed in FIGS. 4 and 6, the end cap 16 is positioned over the contact body 14 to insulate the contact body 14 and the end of the roller 12. The base 42 of the contact body 14 is received in the internal circular channel 58 of the end cap. The end cap 16 is then affixed to the end of the roller 12 by fasteners 62. The end cap 16 also is maintained within an imaginary plane P1 formed by extending the outer circumference of the cylindrical section 20 (FIG. 6). Because the outer diameter D2 of the end cap 16 is less than the outer diameter D of the cylindrical section, the end cap 16 is also positioned within the imaginary plane P1. This is represented by the distance "B" in FIG. 6. Thus, both the contact body 14 and the end cap 16 pierce the imaginary plane P1 and are preferably positioned within the imaginary cylinder formed by the plane P1. No outer surfaces of the contact body 14 or end cap 16 extend beyond the imaginary plane P1 defined by the outer diameter D of the cylindrical section 20. Therefore, the entire heated roller assembly 10 can fit better within tight or narrow clearances not possible with prior devices.

When the contact body 14 and end cap 16 of FIGS. 7–10 are utilized, the fasteners 62 pass through openings 56 of the end cap 16 and into openings 34 (FIG. 2) in the end of the roller 12 (FIG. 4). The outer surface 46 of the contact body 14 is held against the conductive layer 38 on the conical portion 22. Thus, the roller, contact body, and cap rotate together. This construction is beneficial in case the roller 12 "walks" due to roller heat expansion. When "walking," the roller 12 moves in a direction parallel to its longitudinal axis L (FIG. 2). If the end cap 16 was externally supported and did not move the roller 12, the roller 12 could collide with the end cap 16 upon expanding. Because the end cap 16 moves with the roller 12, however, there is less chance of the roller 12 colliding with the end cap 16.

If foreign objects come in contact with portion A (FIG. 6), where the outer surface 46 of the contact body 14 contacts the conical portion 22, the conductivity of this connection could be adversely affected. To prevent contaminants from entering this area, a pair of spaced apart O-rings 70,72 are used to form an O-ring seal (FIGS. 4 and 6). The O-rings are normally made from silicon rubber. The first O-ring 70 is disposed between the roller 12 and the end cap 16. The second O-ring 72 is disposed between the roller 12 and base 42 of the contact body 14. The pair of O-rings 70,72 thus isolates the area where the outer surface 46 contacts the conical portion 22.

The wire 18 is connected to a power supply via commonly known techniques to deliver electricity to the contact body which will heat the roller (FIGS. 1 and 4). One end of the wire is connected by well known conventional method to the power supply (shown schematically in FIG. 1); the other end of the wire then passes through the shaft 30 and end cap 16. The wire 18 proceeds up between the contact body 14 and end cap 16. The wire 18 passes into opening 48 in the contact body 14 (FIG. 4). The wire 18 contacts the flange 44 which makes an electrical connection with the electrically conductive outer surface 46. FIGS. 7 and 8 also disclose the opening 48 in the contact body 14. A set screw (not shown) passes through opening 50 to hold the wire 18 in place. Electricity can then pass through the wire 18 and to the outer surface 46 of the contact body 14. The electricity is then further conducted to the conductive layer 38. The resistance in the conductive layer 38 generates heat, which passes through the outer insulative layer 40, to heat the roller 12 and also a product passing over the roller 12. When each end of the roller is equipped with a contact body, additional wires (not shown) can pass through the length of the shaft 30 and contact the contact body at an opposite end of roller 12. A single power supply can deliver electricity to both ends of the roller 12.

The heat requirements of the roller 12 will determine the size of the wire 18 required. The temperature of the roller 12 is controlled by controlling the amount of current carried by the wire 18. Although a wire 18 is used in the preferred form of the invention, other electrically conductive materials could also be used.

If the thickness of the conductive layer 38 is increased, the resistance is increased. Thus, the heat generated is increased. In addition, the wattage and power that can be developed in the layer 38 is increased. The higher the wattage of the roller 12, the more responsive the roller 12 will be to heat loss. It will take less time for the roller 12 to recover from heat loss as heat is transferred to a product passing over the roller 12.

Figure 15:
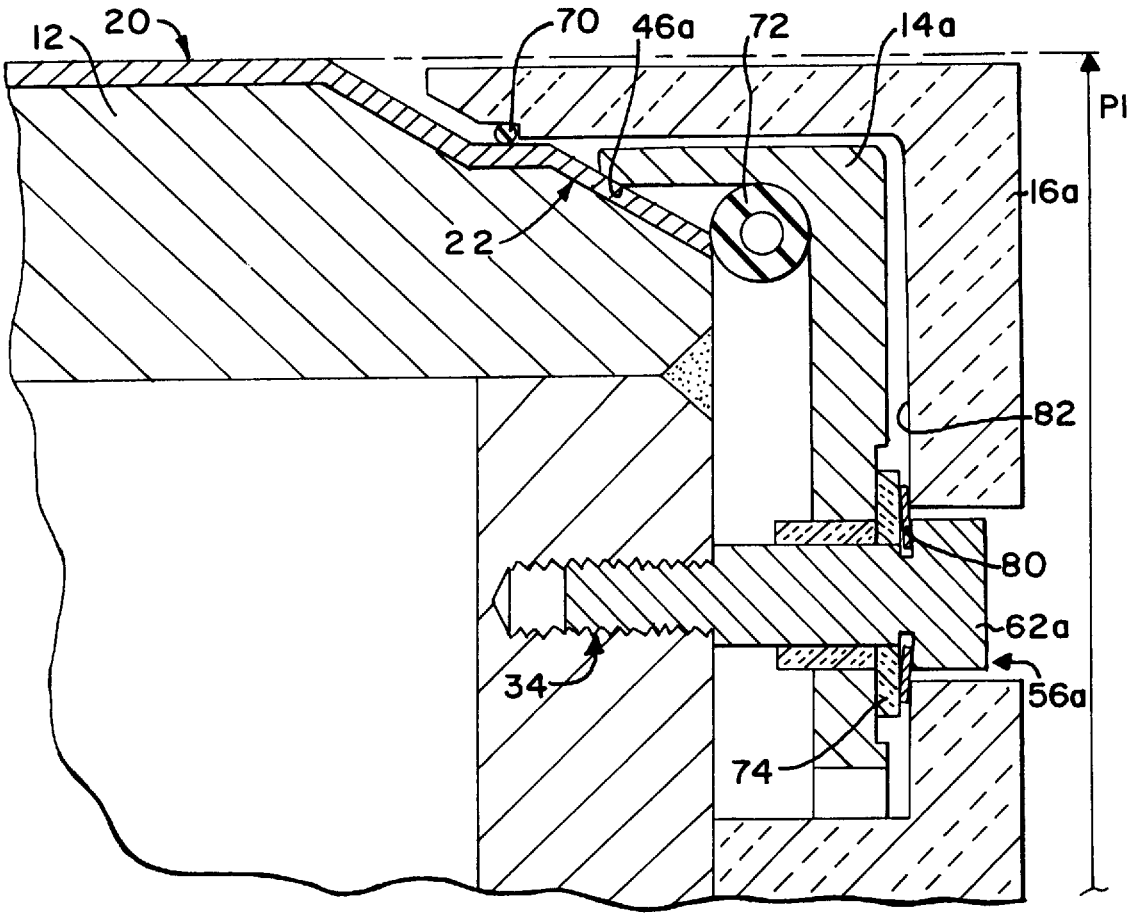

The construction of the heated roller assembly 10 is basically the same when using the second embodiment of the contact body 14*a* and end cap 16*a* of FIGS. 11–14. FIG. 15 shows the contact body 14*a* contacting the roller 12 and the end cap 16*a* affixed to the end of the roller 12. The contact body 14*a* contacts the conical portion 22 of the roller 12 in the same manner as previously described. The outer surface 46*a* of the contact body 14*a* projects towards and contacts the conductive layer 38 of the conical portion 22 while piercing the imaginary plane P1, an extension of the outer diameter D of the cylindrical section 20.

A fastener 62*a* affixes the end cap 16*a* and contact body 14*a* to the end of the roller 12. This fastener 62*a* passes through the opening 56*a* of the end cap 16*a* and also through the aligned aperture 60 of the contact body 14*a*. The aperture 60 has inserted therein, an insulative bushing 74 to help prevent heat loss. The fastener 62*a* then passes into opening 34 in the end of the roller 12. As in the previous embodiment, the roller 12, contact body 14*a* and end cap 16*a* rotate together.

As further disclosed in FIG. 15, the contact body 14*a* is biased against the roller in this embodiment. A spring 80 is disposed between an inner surface 82 of the end cap 16*a* and the insulator bushing 74 in the contact body 14*a*, and exerts a force against the contact body 14*a*. This configuration will take up any expansion of the roller as the roller heats up. Also, the electrical connection between the outer surface 46 of the contact body 14*a* and conical portion 22 of the roller 12 is enhanced.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

The invention claim is:

1. A heated roller assembly comprising:

a generally cylindrical section adapted to rotate and with an outer diameter, the cylindrical section including heater means therein;

an inwardly projecting conical portion adjacent the cylindrical section adapted to rotate with the cylindrical section and having an inner electrically insulative layer, an electrically conductive layer electrically connected to the heater means and an outer electrically insulative layer respectively thereover, a portion of the conductive layer being exposed;

an external contact body also adapted to rotate with the cylindrical section and having at least one electrically conductive outer surface projecting towards, urged against, and physically contacting the conductive layer of the conical portion while being maintained within an imaginary cylinder formed by extending the outer circumference of the cylindrical section; and, means for electrically connecting the outer surface of the contact body to a power supply.

2. The heated roller assembly of claim 1 wherein the conical portion of the roller forms an end of the roller adjacent the cylindrical section of the roller and the contact body is annular having an outer diameter less than the outer diameter of the cylindrical section.

3. The heated roller assembly of claim 2 wherein the contact body includes a base and an extending flange, the conductive outer surface being a part of the flange and the base being spaced from the conical portion.

4. The heated roller assembly of claim 3 further including an electrically insulated end cap affixed to the end of the roller having the conical portion.

5. The heated roller assembly of claim 4 wherein the end cap has an outer diameter less than the outer diameter of the roller.

6. The heated roller assembly of claim 5 wherein the cap has an internal circular channel for holding the base of the contact body therein.

7. The heated roller assembly of claim 6 wherein the cap has openings therein for receiving a fastener and is affixed by the fastener to the end of the roller having the conical portion.

8. The heated roller assembly of claim 7 wherein the contact body is biased against the roller by a spring positioned between the contact body and cap.

9. The heated roller assembly of claim 2 wherein the inwardly projecting conical portion adjacent the cylindrical section of the roller includes two beveled sections, with the inner insulative layer, conductive layer and outer insulative layer respectively thereover, a portion of the conductive layer being exposed on the beveled section closest to the end of the roller and furthest from the cylindrical section of the roller.

10. The heated roller assembly of claim 4 further including a two spaced apart O-rings, one O-ring disposed between the roller and the end cap, and the other O-ring disposed between the roller and base of the contact body.

11. The heated roller assembly of claim 4 wherein the roller, contact body, and end cap rotate together.

12. The heated roller assembly of claim 4 wherein the means for electrically connecting the outer surface of the contact body to a power supply is a wire having one end connected to a power supply and another end passing through the end cap and connected to the outer surface of the contact body.

13. The heated roller assembly of claim 4 wherein the roller has opposed ends and a conical portion, contact body and end cap at each end.

14. The heated roller assembly of claim 4 wherein the end cap is made of one of phenolic material and steel.

15. A heated roller assembly comprising:

a roller having two sections, a first section having a first diameter and a second section having a second diameter, the first diameter being greater than the second diameter and both sections adapted to rotate together;

an electrically conductive element connected to the second section of the roller and electrically connected to a heater element integral with the first section of the roller;

an external contact body adapted to rotate with the first and second sections and having at least one electrically conductive outer surface, the outer surface projecting towards, urged against, and contacting the conductive element of the second section of the roller while being maintained within an imaginary plane formed by extending the outer surface of the first section; and, means for electrically connecting the outer surface of the contact body to a power supply.

16. The heated roller assembly of claim 15 wherein the second section of the roller forms an end of the roller adjacent the first section of the roller and the contact body is annular having an outer diameter less than the first diameter of the first section.

17. The heated roller assembly of claim 16 wherein the contact body includes a base and an extending flange, the conductive outer surface being a part of the flange and the base being spaced from the second section.

18. The heated roller assembly of claim 17 further including an electrically insulated cap affixed to the end of the roller, the cap having an outer diameter less than the first diameter of the first section.

19. The heated roller assembly of claim 18 wherein the cap has an internal circular channel for holding the base of the contact body therein and has openings therein for receiving a fastener affixing the cap to the roller.

20. The heated roller assembly of claim 19 wherein the first section is generally cylindrical and includes an inner electrically insulative layer thereover, an electrically conductive layer over the inner insulative layer, and an outer electrically insulative layer over the conductive layer, and the second section is an inwardly projecting conical portion adjacent the cylindrical first section with the inner insulative layer, conductive layer and outer insulative layer respectively thereover, a portion of the conductive layer on the conical portion of the roller being exposed.

21. The heated roller assembly of claim 20 wherein the inwardly projecting conical portion adjacent the cylindrical section of the roller includes two beveled sections, with the inner insulative layer, conductive layer and outer insulative layer respectively thereover, a portion of the conductive layer being exposed on the beveled section closest to the end of the roller and furthest from the cylindrical section of the roller.

22. The heated roller assembly of claim 21 further including two spaced apart O-rings, one O-ring disposed between the roller and the cap, and the other O-ring disposed between the roller and base of the contact body.

23. The heated roller assembly of claim 18 wherein the roller, contact body, and cap rotate together.

24. The heated roller assembly of claim 18 wherein the means for electrically connecting the outer surface of the contact body to a power supply is a wire having one end connected to a power supply and another end passing through the cap and connected to the outer surface of the contact body.

25. The heated roller assembly of claim 18 wherein the roller has opposed ends and a conical portion, contact body and cap at each end.

26. The heated roller assembly of claim 18 wherein the cap is made of one of phenolic material and steel.

27. The heated roller assembly of claim 15 wherein the first section of the roller is integral with the second section of the roller.

28. A heated roller assembly comprising:

a generally cylindrical section adapted to rotate and with an outer diameter, the cylindrical section including heater means therein;

an inwardly projecting conical portion adapted to rotate with the cylindrical section and adjacent the cylindrical section forming an end of the roller with an inner electrically insulative layer, an electrically conductive layer electrically connected to the heater means and an outer electrically insulative layer respectively thereover, a portion of the conductive layer being exposed;

an external annular contact body also adapted to rotate with the conical portion and having an outer diameter less than the outer diameter of the cylindrical section, the contact body having a base and an extending flange, the flange having at least one electrically conductive outer surface projecting towards, urged against, and physically contacting the conductive layer while being maintained within an imaginary cylinder formed by extending the outer circumference of the cylindrical section;

an insulated end cap having an outer diameter less than the outer diameter of the cylindrical section and having an internal circular channel for holding the base of the contact body therein, the end cap affixed to the conical portion by a fastener; and, at least one wire having one end connected to a power supply and another end passing through the end cap and connected to the outer surface of the flange of the contact body to deliver electricity to the outer surface.

29. A heated roller assembly comprising:

a first generally cylindrical section with an outer diameter and a second section adjacent the cylindrical section having a smaller diameter than the first section, both sections adapted to rotate together;

a conductive heat element connected to the second section of the roller and connected to a heater element within or around the first section of the roller;

an external contact body adapted to rotate with at least one section and having at least one electrically conductive outer surface projecting towards, urged against, and physically contacting the conductive element of the second section of the roller, the contact body being positioned within an imaginary plane formed by extending the outer surface of the first section; and, means for electrically connecting the outer surface of the contact body to a power supply.

30. The heated roller assembly of claim 29 wherein the second section is an inwardly projecting conical portion and forms an end of the roller.

31. The heated roller assembly of claim 29 wherein the contact body and roller rotate together.

32. A mechanism for delivering electricity to a rotating roller, the roller having a generally cylindrical section with an outer diameter, comprising:

an inwardly projecting conical portion adjacent the cylindrical section of the roller with at least one annular electrically conductive strip thereon, the conductive strip being electrically connected to the cylindrical section;

an external contact body adapted to rotate with either the cylindrical section or the conical portion and having at least one electrically conductive outer surface projecting towards, urged against, and physically contacting the conductive strip of the conical portion while being maintained at a position within an imaginary cylinder formed by extending the outer circumference of the cylindrical section; and, means for electrically connecting the outer surface of the contact body to a power supply.

33. The mechanism of claim 32 wherein the cylindrical section of the roller is centrally positioned, the conical portion forms an end of the roller, and the contact body is annular having an outer diameter less than the outer diameter of the roller.

34. The mechanism of claim 32 wherein the contact body includes a base and an extending flange, the conductive outer surface being a part of the flange and the base being spaced from the conical portion.

* * * * *